US009493321B2

(12) United States Patent
Kroth et al.

(10) Patent No.: US 9,493,321 B2
(45) Date of Patent: Nov. 15, 2016

(54) METHOD AND DEVICE FOR ADHERING AN EDGE OF A LAMINAR OBJECT

(75) Inventors: Eberhard Kroth, Obernburg (DE); Harald Danz, Würselen (DE); Thomas Bischof, Aachen (DE); Andreas Hibert, Düren (DE)

(73) Assignee: REIS GROUP HOLDING GMBH & CO. KG, Obernburg (DE)

( * ) Notice: Subject to any disclaimer, the term of this patent is extended or adjusted under 35 U.S.C. 154(b) by 276 days.

(21) Appl. No.: 13/203,548

(22) PCT Filed: Feb. 26, 2010

(86) PCT No.: PCT/EP2010/052467

§ 371 (c)(1),
(2), (4) Date: Aug. 31, 2011

(87) PCT Pub. No.: WO2010/097458

PCT Pub. Date: Sep. 2, 2010

(65) Prior Publication Data

US 2011/0308713 A1 Dec. 22, 2011

(30) Foreign Application Priority Data

Feb. 27, 2009 (DE) ..... 10 2009 003 550

(51) Int. Cl.

| | |
|---|---|
| ***B32B 38/04*** | (2006.01) |
| ***B65H 35/00*** | (2006.01) |
| ***B65H 37/00*** | (2006.01) |

(52) U.S. Cl.

CPC ..... *B65H 35/0013* (2013.01); *B65H 37/002* (2013.01); *Y10T 156/10* (2015.01); *Y10T 156/1056* (2015.01); *Y10T 156/1062* (2015.01); *Y10T 156/1322* (2015.01)

(58) Field of Classification Search

CPC B65H 35/0013; B65H 37/002; B32B 38/04; Y10T 156/10; Y10T 156/1056; Y10T 156/1062; Y10T 156/1322

USPC ..... 156/196, 199, 200–202, 212, 216, 250, 156/252, 253, 256

See application file for complete search history.

(56) References Cited

U.S. PATENT DOCUMENTS

| | | | | |
|---|---|---|---|---|
| 4,738,075 | A * | 4/1988 | Marchetti | 53/136.4 |
| 4,980,011 | A * | 12/1990 | Gruber et al. | 156/361 |
| 5,482,593 | A | 1/1996 | Kuhn et al. | |
| 7,368,032 | B2 * | 5/2008 | Green et al. | 156/264 |

FOREIGN PATENT DOCUMENTS

| | | |
|---|---|---|
| DE | 3878287 T2 | 7/1993 |
| DE | 102004021622 B3 | 9/2005 |

* cited by examiner

*Primary Examiner* — Mark A Osele
*Assistant Examiner* — Christopher C Caillouet
(74) *Attorney, Agent, or Firm* — Ladas & Parry LLP

(57) ABSTRACT

The invention relates to a method for adhering an object (12) having an adhesive tape (16) preferably having a liner (26), wherein the object having the adhesive tape contacts and is applied to the object during transport of the object having the likewise transported adhesive tape and wherein the speed of the object and the speed of the adhesive tape are synchronized during the adhesion. In order to enable adhesion of the object without influencing the adhesive tape, whereby the adhesive effect could be negatively influenced, according to the invention the object is transported by means of a handling arrangement and both the velocity and acceleration curves of the object are transferred to the transport of the adhesive tape via an axis of the handling device.

28 Claims, 3 Drawing Sheets

METHOD AND DEVICE FOR ADHERING AN EDGE OF A LAMINAR OBJECT

Figure 1:
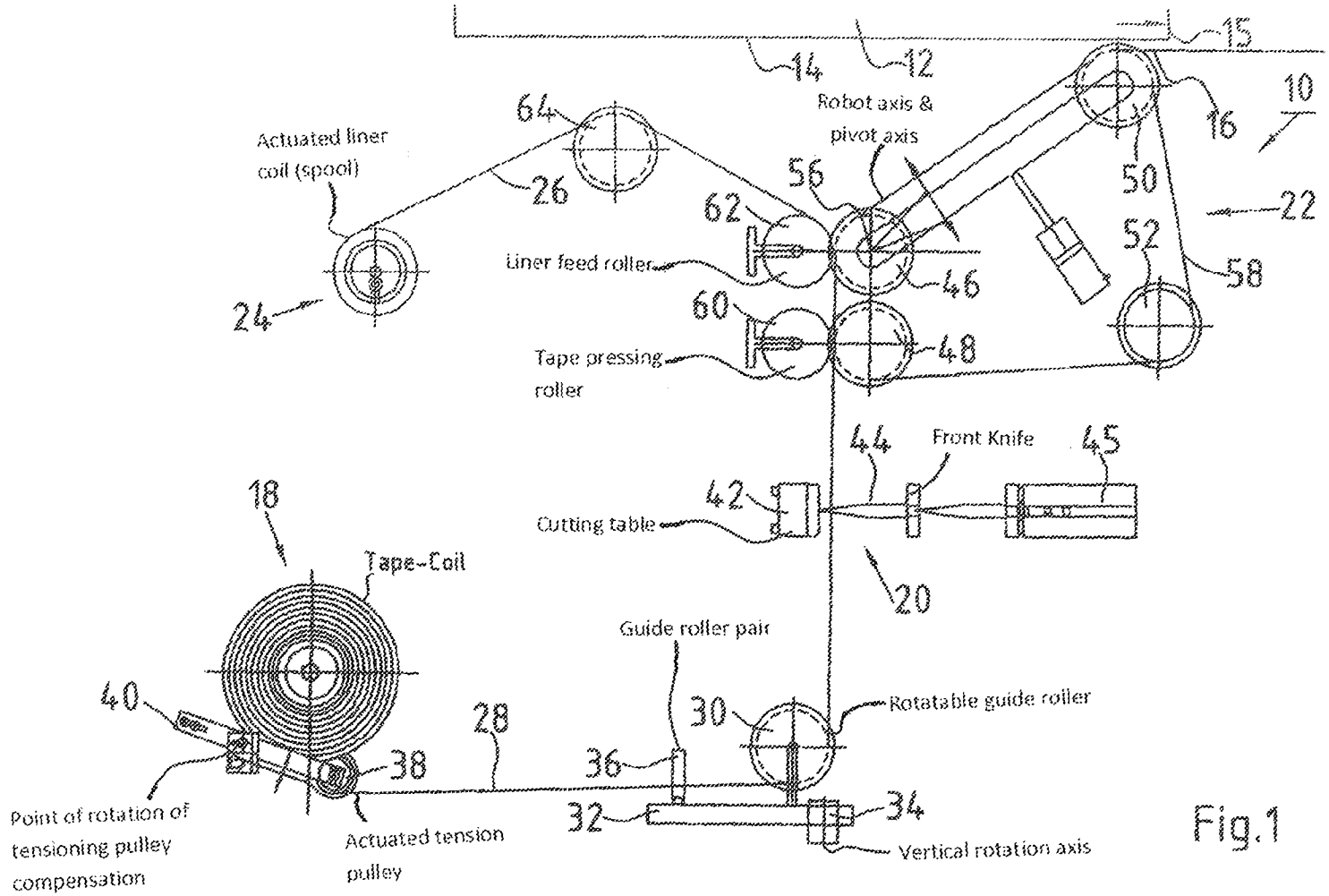

This application is a 371 of PCT/EP2010/052467 filed on Feb. 26, 2010, which is incorporated herein by reference.

The invention concerns a method for laminating an object with an adhesive tape that preferably comprises a liner, in particular for laminating or covering an edge of a plane object, wherein the object contacts the adhesive tape and during the transport of the object the adhesive tape, which is likewise transported, is applied to the object, and wherein the velocity of the object and that of the adhesive tape are synchronized during the lamination.

Furthermore the invention refers to a device for laminating an object, in particular for laminating or covering an edge of a plane object with an adhesive tape that preferably comprises a liner, encompassing provisioning such as a spool for the adhesive tape, a cutting device, a device that guides the adhesive tape to the object, as well as a first drive for the device and a second drive for the object, wherein the drives for the transport of the adhesive tape and the object can be synchronized.

In the case of plane objects such as solar cell modules it is necessary that the longitudinal edges of the panes that enclose the solar cells on the outer side be covered by an adhesive tape that is then crimped, i.e. that it extends along the side edges of the panes and adheres thereto.

In the case of the known methods the object (e.g. a solar module) is placed on the adhesive tape. Through the feed motion of the object by means of a handling device, such as for example a robot, the adhesive tape is pulled off the provisioning spool by the contact friction/force between adhesive tape and the edge of the object and adheres to the edge of the object. If applicable, the tape is still subsequently crimped around the edge. The peeling-off of the adhesive tape takes place because of the movement of the module, so that the tape is stretched during the peeling-off as a result. As a result a pretensioned adhesive tape ends up on the outer edges of the panes, so that it shortens in the event that it should not remain adherent and the edge is therefore not covered completely. A further disadvantage of the known methods is that, prior to the adhesive tape contacting the object, the side of the adhesive tape that contacts the edge comes in contact with components of the unspooling device, such that the adhesive effect can be thereby diminished.

An apparatus for the application of adhesive tape can be discerned from DE-T-695 03 548 (EP-B-O 676 352). The adhesive tape, which does not feature a liner, is applied to a material sheet via an actuated vacuum wheel. The velocity of the material sheet is determined by means of a CPU in order to then drive the vacuum wheel at the same velocity after an initially required acceleration. The length of the adhesive tape that is applied to the vacuum wheel has to be smaller than the circumference of the vacuum wheel for the acceleration of the vacuum wheel that is necessary for synchronization.

DE-A-44 021 622 refers to a device and a method for the application of an adhesive tape. To that effect the adhesive tape is grasped between rollers and peeled off a provisioning spool under tension, in order to be aligned along an object, such as an edge of a paper roll, which the tape is to be applied to. After the alignment of the adhesive tape along the object the adhesive tape is pressed down on it.

The object of DE-T-38 78 287 (EP-B-O 286 343) is a device for the application of adhesive tape on a product. The adhesive tape is guided via a floating roller in order to be able to apply it essentially tension-free. Furthermore there is the possibility of modifying the velocity of the application depending on the arising tension.

It is the object of the present invention to further improve a method and a device of the kind referred to initially in such a manner that a lamination of an object takes place, in particular a lamination or covering of a plane object, without the adhesive tape being affected such that the adhesive effect could be diminished. An adhesion process should also be facilitated that provides reproducible quality.

The object is met process-wise essentially by transporting the object by means of a handling device and by transmitting the velocity as well as also the acceleration progression of the object synchronously to the transport of the adhesive tape via an axle of the handling apparatus.

According to the invention the object is transported via a handling device whose controller maps the velocity and acceleration progression of the object being transported in real time to the transport of the adhesive tape.

The adhesive tape is not moved along by means of contact friction or force with the object. No stretching of the adhesive tape takes place, so that it is laminated tension-free onto the object, such as an edge. In the context provision is particularly made that the adhesive tape is peeled without stretching off of the provisioning unit, meaning in particular the roll on which the adhesive tape is spooled, and that it is transported.

The adhesive tape is actively transported, wherein velocity and acceleration progression of the transported object are transmitted to the transport of the adhesive tape. Object and adhesive tape are quasi moved by means of a common electronic shaft, so that a precise lamination of the adhesive tape onto the object is assured. The danger of wrinkling or of a tear is therefore eliminated.

This however does not exclude the possibility that the synchronization of the velocity and acceleration progression is achieved such that a desired tension is produced directly and therefore controlled in the adhesive tape, be it in a compressing or a stretching manner. Preferably the lamination is however implemented tension-free.

A compressed or stretched application of adhesive tapes can be advantageous in the case of certain applications. This can take place across an entire side or also only partially. In the case of significant reorientations along the application track of the adhesive (e.g. the circumferential lamination of corners) a compressed and/or stretched application can be advantageous in order to facilitate an improved placement of the product.

Furthermore product properties such as tape-height and -width can likewise be modified just as effectively, through compressed or stretched application (in the case of suitable adhesive tapes), as the density of one of the applied tapes.

Deviating product properties can thereby be produced with suitable adhesive tapes. For example amount of the application, hardness of the adhesive tape etc. Furthermore a compression or a stretching of the product can be advantageous in the case of significant reorientations, e.g. corners that have to be laminated.

The transport installation for the adhesive tape is actuated according to the invention via an additional axis of the handling device, e.g. a robot, such that said axis moves absolutely synchronously to the movement of the object.

The control of the axis takes place via the controller of the handling device, so that due to it the velocity profile of the handling device, such as the robot, and therefore the movement of the object, including acceleration and delay ramps, is mapped in real time by the device transporting the adhesive tape.

Due to the teaching according to the invention the length of the contact area, in which the adhesive tape is fixed on the transport installation that then transfers the adhesive tape onto the object, can be independent of the length of the adhesive tape to be applied. In other words, the contact length can be the same or be different from the length of the adhesive tape section that is laminated onto the object.

In particular a conveyor belt such as a transport belt is used as a transport installation for the adhesive tape, even if other suitable means can also be considered, such as a feed spool or -wheel with a suitably large diameter.

In particular, provision is made that the conveyor belt is guided across a roller with a drive axis that is operated via the controller of the handling device.

The conveyor belt is guided across two, preferably across three, in particular across four rollers that can be pivoted altogether as a unit. In the area of one of the rollers the adhesive tape is then brought into contact with the object. To that effect the unit is pivoted in the direction of the object so that the adhesive tape can adhere to the required extent to the edge and be pressed onto it.

In an improvement of the invention provision is made that the rollers that guide the conveyor belt or the transport belt encompass two rollers that preferably are arranged vertically above one another, wherein a pressing roller for the adhering of the adhesive tape to the conveyor belt is associated with one of the two rollers, preferably the lower one.

A liner deflection roller or take-off should be associated with the other, preferably the upper of the two rollers, via which the liner is separated or peeled from the adhesive tape and guided to an actuated shaft or roller that reels the liner up. In the process the shaft or roller that is reeling up the liner can be actuated via a motor with an adjustable torque to assure the required liner tension. The shaft that is reeling up the liner takes effect up to the liner deflection or take-off roller, or up to the transport installation. A tape that encompasses the liner with the adhesive tape is peeled off from a spool by the transport installation. In this case the tape can be reeled up in one or several rows.

A tensioning pulley should be associated with the spool that abuts against the spool itself, wherein the tensioning pulley is actuated in the direction opposite to the peel-off direction of the tape. The tension of the tape can be adjusted in particular via the torque of the drive of the tensioning pulley.

The tape is guided via guiding rollers in the case where the tape is reeled up in multiple rows. This can involve grooved rollers or guiding rollers that are spaced apart from one another in order to assure an orderly alignment on the conveyor belt or the transport belt and therefore on the object.

Independently thereof the tape that is peeled-off from the spool is redirected vertically via a guiding roller. The guiding roller can in that case originate from a retaining means that can be rotated about a vertically running axis, so that an alignment with the row to be peeled off the spool is achieved.

Furthermore provision is made that a cutting device is disposed between the guiding roller and the conveyor belt, by means of which the adhesive tape is cut or perforated, without the liner being severed, depending on its length that is to be laminated onto the object. The feed of the adhesive tape and therefore also the movement of the handling apparatus can be halted during the cutting through or perforating. The possibility however also exists that a separating element moves synchronously along at the transport velocity of the adhesive tape, so that cutting through and perforating is possible without halting the object and therefore the conveyor belt.

Independently thereof a separating element such as a knife should be used that is for example coated with Teflon and/or can be heated in order to prevent contamination by the adhesive of the adhesive tape, with the result that otherwise a precise cutting through or perforating of the adhesive tape would not be possible or would be negatively affected.

A device of the kind referred to initially is characterized by the fact that the object can be transported via a handling device whose controller maps the velocity and acceleration progression of the object onto the drive axis of an adhesive tape transport installation, which encompasses the device, during the lamination of the object with the adhesive tape in real time.

In the process provision is in particular made that the length of the contact area for the adhesive tape on the transport installation is independent of the length of the adhesive tape section that is to be laminated onto the object.

Furthermore the adhesive tape is preferably joined with a liner, so that the adhesive tape is transferred onto the transport installation tension-free because the transporting force for the transport of the adhesive tape is applied to the liner.

The transport force is transferred to the transport installation via the liner. The transport velocity of the liner and the transport velocity of the transport installation are equal during the contact of the adhesive tape with the transport installation. The liner is then separated from the adhesive tape after a prescribed transport distance on the transport installation and the transport force is transferred via the transport installation. Consequently it is assured that no uncontrolled forces act on the adhesive.

The transport installation, by means of which the adhesive tape is transferred to the object, should encompass at least two rollers that guide a conveyor belt that receives the adhesive tape and of which one features a drive axis that can be operated via the controller of the handling device.

Alternatively a transport roller or a transport wheel can be used as the device for receiving and transporting the adhesive tape and that can be operated via the controller of the handling device.

The at least two rollers should be implemented as a unit that can be pivoted toward the handling device in order to thereby be able to press the conveyor belt and consequently the adhesive tape against the object with the required pressurization.

In particular provision is however made that the unit encompasses at least three, preferably four, rollers that guide the conveyor belt. In this case preferably two of the at least three rollers should be arranged vertically above one another.

In an embodiment of the invention it is proposed that above the two rollers, which are arranged vertically and preferably above one another, a liner deflection roller is disposed via which the liner, which was separated or peeled off from the adhesive tape, can be guided toward a shaft that receives said liner. In the process the shaft that reels up the liner should be drivable via a motor with an adjustable torque in order to assure by these means the desired liner tension.

A pressing roller that presses the adhesive tape onto the conveyor belt should be associated with the lower of the two rollers that preferably are arranged one above the other.

Furthermore one roller of the unit, which functions as the entry point or area of the adhesive tape onto the edge of the object, extends in a a manner offset to and above the upper roller.

A vertical alignment of the rollers is of course not stringently required. The device can also be deployed in a rotated manner. Variations of the redirection angles of the tape from the spool to the pressing roller are also possible.

In a further improvement provision is made that associated with the spool that features the one- or multi-row tape is a tensioning pulley that abuts against it, and that said tensioning pulley is actuated in the direction opposite to the tape peel-off direction with a preferably adjustable torque. The pretension can therefore be set by simple means.

Furthermore a guide roller that redirects the tape from the approximately horizontal to the vertical is disposed between the spool and the unit that preferably comprises four rollers. Furthermore a guidance device that guides the tape laterally can be disposed in front of and/or behind the guide roller, in particular in the case where the tape is reeled onto the roller in multiple rows.

The guidance device can encompass two guiding rollers that rotate about vertically extending axes. Additionally or supplementary a grooved guiding roller can be considered, wherein the width of the groove corresponds to that of the tape.

A cutting device is disposed between the guidance device and the unit that features the conveyor belt and it encompasses preferably a heatable and/or coated separating element, such as a knife. As a coating Teflon can for example be considered.

The separating element can be moved along with the tape for purposes of cutting through or perforating the adhesive tape without the liner also being cut through or perforated, consequently a so-called flying knife cutter can be deployed. This provides the advantage that the handling device and therefore the conveyor belt do not have to be halted for the cutting through or perforating of the adhesive tape.

In order to exclude the possibility of the tape swerving, a further improvement provides that the cutting device features a cutting support such as a table against which the liner abuts or is supported during the cutting through or perforating of the adhesive tape.

Further details, advantages, and characteristics of the invention can be gathered not only from the claims, from which the characteristics can be gathered—as such and/or in combination—but also from the following description of a preferred embodiment that can be gathered from the drawing.

Figure 2:
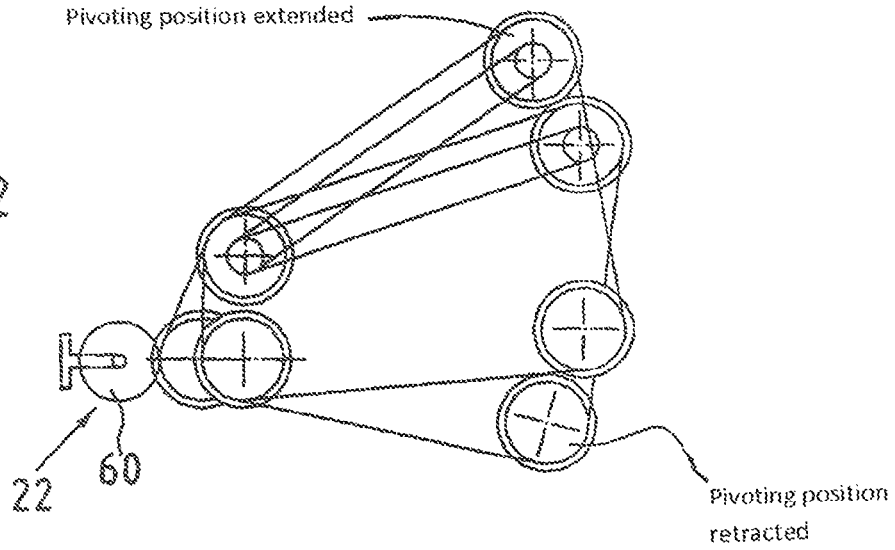
Figure 3:
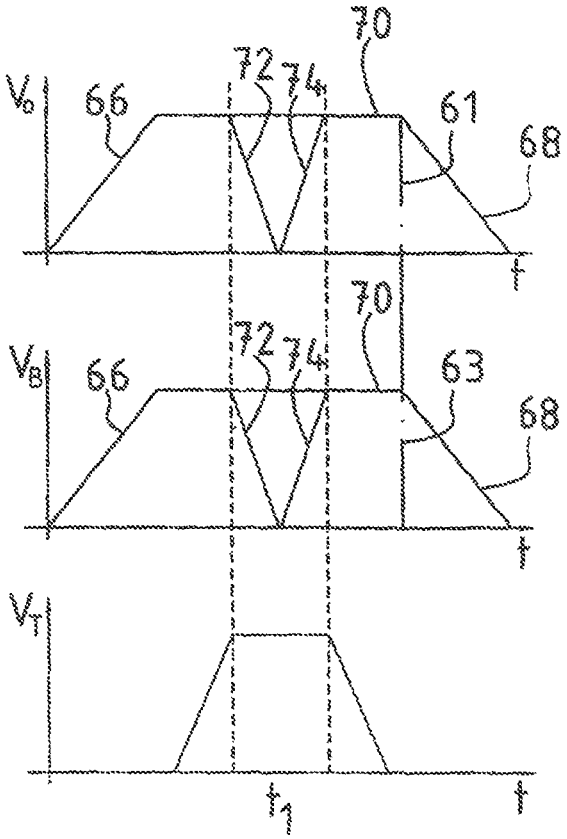
Figure 4:
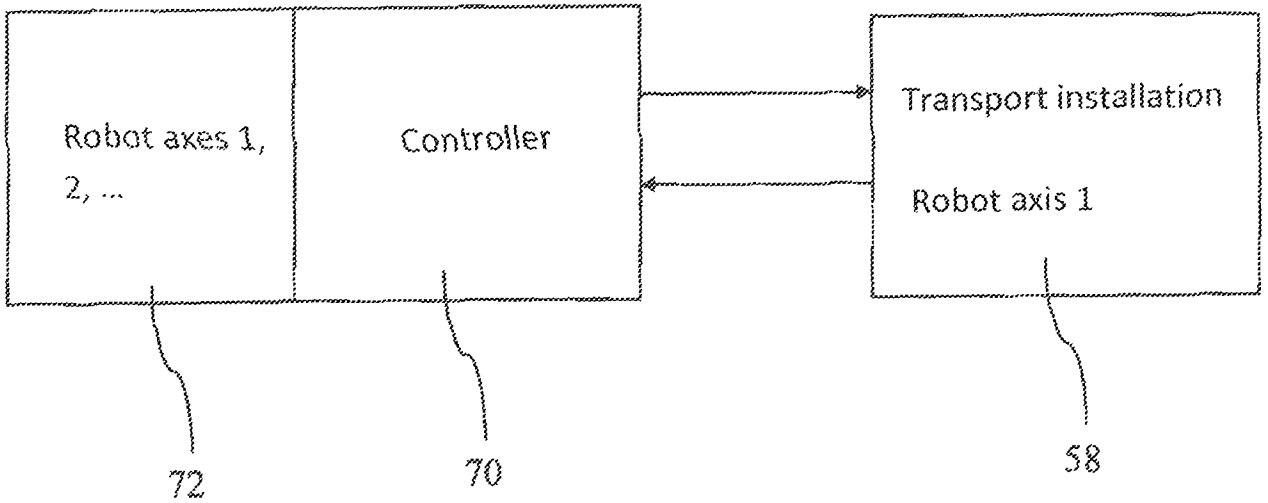

The drawings show:

FIG. 1: a device for laminating an edge of a plane object,

FIG. 2: a detail of FIG. 1,

FIG. 3: velocity profile of elements of the device according to FIG. 1 and FIG. 4: a block diagram.

The teaching according to the invention is explained based on the covering of an edge of a plane object, such as a solar cell module, without a limitation being implied hereby. Instead the teaching according to the invention is suitable for any application of an adhesive tape on an object, which additionally does not require a plane surface. To that effect the possibility exists of coordinating the velocity or acceleration of the object with the effective length of the area to be laminated. This is implemented by means of a handling device such as a robot. The adhesive tape can be applied tension-free because the adhesive tape has an identical velocity and acceleration progression as the handling device due to the teaching according to the invention. In the process it has to of course be assured that the pressure element via which the adhesive tape is pressed onto the object can follow the corresponding surface contour.

A schematic diagram of the device 10 can be gathered from FIG. 1, via which an adhesive tape 16 is to be laminated onto a plane object 12, and namely onto the longitudinal edges 14, 15 thereof, and is to be subsequently crimped so that it adheres with its edge areas to the side edges of the object 12. The plane object 12 can for example be a solar cell module that features panes between which the solar cells are disposed, without there being the intend to limit the teaching according to the invention hereby.

In FIG. 1 a section of the double-sided adhesive tape 16 is displayed, wherein in practice such a section would not protrude freely, but instead would rather adhere to the longitudinal edge 16 of the object 12, wherein the longitudinal edge 14 itself directly contacts the adhesive tape 16. For illustration purposes object 12 is, however, displayed spaced apart from the adhesive tape 16.

The essential components of the device 10 are a tape-coil labeled 18, a cutting device 20, a device labeled as a transport station 22, as well as a liner-coil 24.

A tape 28 comprising the adhesive tape 16 and the liner 26 that covers it on one side is reeled up on the spool 18 in a preferably multi-row manner. A guide roller 30 redirects said tape from the approximately horizontal to the vertical. The guide roller 30 is implemented as a guiding roller, meaning it can be grooved in order to feed the tape 28 in a guided manner through the cutting device 20 of the transport station 22.

The guide roller 30 originates from a retaining means 32 that can be pivoted about a vertically running axis 34, so that an alignment along the course of the tape 28 can be performed in the case when the tape 28 is reeled up on the spool 18 in a multi-row manner.

A pair of guiding rollers 36 for the guiding of the tape 28 originates from the retaining means 32 with a clearance gap that corresponds to the width of the tape 28.

In order to pretension the tape 28 to the desired extent, the tape 28 is guided across a tensioning pulley 38 that originates from a lever 40 in a pivotable manner. The tensioning pulley 38 abuts against the spool 18 and is actuated, wherein the rotational direction of the tensioning pulley 38 is in the direction opposite to the peel-off direction of the tape 28, with the result that the desired tape tension is adjustable. To that effect the torque of the drive of the tensioning pulley 38 can also be correspondingly modified.

The tape 28 traverses after its vertical alignment the cutting installation 20 that features a cutting support or a cutting table 42 on the side of the liner 26 and a separating element, such as a knife 44, on the side of the adhesive tape 16. The knife 44 that is preferably heated and/or provided with a coating, such as a Teflon coating, can be implemented stationary relative to the transport direction of the tape 28 or it can be movable along with it, depending on whether the cutting through or perforating of the adhesive tape 16 is to be performed on a stopped or a moving tape 28.

The transport station encompasses in the embodiment four rollers 46, 48, 50, 52 that are pivotable as a unit, namely in the embodiment about the axis 54 of the roller 46, which at the same time is also the drive axis. This however does not represent a limitation of the teaching according to the invention. The pivoting axis can also extend through a different point of the transport station 22. The same applies for the drive axis.

The rollers 46, 48 are arranged on top of one another, preferably along the vertical. Roller 50, which extends above and offset to the side of roller 46, serves as a contact point or area in which the adhesive tape 16 is pressed against the longitudinal edge 14, 15 to be laminated and is joined with it. The adhesive tape 16 is consequently transported without the liner 26 by the section of the conveyor belt 58 that extends between the rollers 46, 50 and such that it adheres to it without contact with other components, so that the adhesive layer contacts the longitudinal edge 14 of the object 12 unimpaired.

A conveyor band or belt 58, to which the adhesive tape 16 adheres, extends across the rollers 46, 48, 50, 52, so that a relative movement between the adhesive tape 16 and the conveyor belt 58 no longer takes place. Instead the adhesive tape 16 is transported along at a velocity that corresponds to that of the conveyor belt 58.

A pressing roller 60, via which the adhesive tape 16 together with the liner is pressed against the conveyor belt 58 for the purpose of adhering to it, is associated with the lower of the rollers 46, 48 that are arranged preferably vertically above one another. In the process the desired press-on force can be adjusted. Additionally the adherence of the adhesive tape 16 to the surface of the conveyor belt 58 can be adjusted to the desired extent by setting the gap between the surfaces of the pressing roller 60 and the associated roller 48 of the transport station 22 or through the combination of press-on force and gap.

A so-called liner pull-off roller 62 is associated with the upper of the rollers 46, 48 that are arranged preferably vertically above one another, such that it redirects the liner 26 that is consequently separated or pulled off from the adhesive tape 16 in order to be guided to an additional guide roller 64 of the spool 24. The spool 24 is likewise actuated. As motor a version with adjustable torque can be used, via which the tension of the liner 26 can be set from the liner pull-off roller 62 to the reel up on the shaft of the roller 24. This tension is set corresponding to the liner characteristics.

The transport force for transporting the adhesive tape 16 is initially transferred via the liner 26. The adhesive tape 16 is pressed onto the conveyor belt via the pressing roller 60. The transport velocity of the conveyor belt 58 and the liner 26 are equal. In the area of the liner pull-off roller 62 the liner 26 is separated from the adhesive tape 16 and the transport force for transporting the adhesive tape 16 is therefore transmitted completely via the conveyor belt 58. This measure assures that the adhesive tape 16 is transported tension-free on the conveyor belt 58 up to the transfer onto the object 12.

The transport station 22 is pivotable, as is implied by FIG. 2, wherein the pressing roller 60 can be an integral component of the transport station 22.

Two positions that the transport station 22 can occupy are displayed in FIG. 2. The upper pivot position reflects the one in which the object 12, meaning its longitudinal edge 14, is to be laminated with the adhesive tape 16.

During the cutting process roller 50, which carries out the function of a pressing roller during the lamination of the edge 14, remains at the object 12.

In order to assure a clear separation between the tape 16 adhering to the edge 14 and that adhering to the conveyor belt 58 at the end of the lamination of the edge 14 with the adhesive tape 16, the unit is pivoted into the lower one in FIG. 2, meaning the retracted pivot position. The stroke contingent thereon assures a clear separation and in particular in the case of a perforated adhesive tape the perforation of the adhesive tape 16 is cleanly torn.

The liner 26 is supported by the cutting table 42 in order for the tape not to be able to swerve during the swerving while the cutting through or perforating of the adhesive tape is performed.

The front cutting position of the knife 44 is established via an adjustable fixed stop in order to assure that the liner 26 is not cut through. Furthermore the knife 44 is connected to a linear feed unit 45 in the embodiment in order to be able to cut through or to sever the adhesive tape 16.

According to the invention provision is made that the conveyor belt 58 or the transport belt is actuated via the axis 56, which is moved absolutely synchronously with the movement of the object 12. The control of the drive axis 56 takes place via the controller of a handling device that is not further illustrated, namely a robot, by means of which the plane object 12 is moved along the roller 50 during the lamination with the adhesive tape 16.

The drive axis is consequently a robot axis via which the velocity profile of the robot, including the acceleration—and delay ramps, is mapped by the conveyor belt 58 in real time.

This is to be explained based on FIG. 3. In the upper illustration the velocity Vo of the robot and therefore of the object 12 is plotted as a function of the time t. In the center illustration the velocity $V_B$ of the belt 58 is presented versus time t, and in the lower illustration the velocity $V_T$ of the knife 44 is presented versus time t when it is moved with the tape 28.

Consequently the velocity profile 61 of the robot and therefore of the object 12 is displayed in the upper illustration of FIG. 3 during the lamination of the longitudinal edge 14 with the adhesive tape 16. One recognizes the acceleration ramps 66, 68 at the beginning and toward the end of the lamination of the longitudinal edge 16. Between the ramps 66, 68 the object is transported at constant velocity, as clarified by the plateau 70. This velocity is maintained, provided that either the spacing between the roller 50, in which the object 12 contacts the adhesive 16, and the separating element 44 is shorter than the length of the longitudinal edge 14 or 15 that is to be laminated, or instead a cutting through or perforating of the adhesive tape 16 takes place with a moving knife 44.

If, on the other hand, the spacing is wider than the length of the edge 14 or 15 that is to be laminated, then the tape 28 has to be stopped while the knife 44 is not moving in order to coordinate the belt length with the length of the corresponding longitudinal edge 14 or 15. To this effect the robot and therefore the object 12 is decelerated or accelerated. This is symbolized by the ramps 72, 74.

In other words, the object 12 is always stopped, while the knife 44 is stationary, in a position in which the distance from the pressing roller 50 to the cutting station 22 is identical to the distance from pressing roller to the coating end (end of edge 14).

The conveyor belt 58 features an identical velocity profile 63, as is clarified by the center illustration in FIG. 3.

The lower illustration of FIG. 3 reflects the velocity profile of the knife 44 when it is moved along with the tape 28.

In window t1 the cutting through of the adhesive tape 16 takes place corresponding to the illustration in FIG. 3. In the process the knife 44 has to either have the same velocity as the object 12 in the window t1 in order to cut through or to perforate the adhesive tape 16, or the robot and therefore the object 12 and consequently also the conveyor belt 58 has to halt in the window t1 so that the stopped adhesive tape 16 can be cut through or perforated with the stationary knife 44.

One can speak of an electronic shaft, via which the transport installation for the object as well as also the transport installation for the adhesive tape is actuated.

This is to be explained on a principle basis by FIG. 4. It can be gathered therefrom that a handling device 72 (robot) comprises a controller 70 and several axes 1, 2, . . . . One of these axes is the drive axis for the conveyor belt 58. Through the controller 70 it is therefore assured that the resulting surface velocity of the object 12 and the velocity of the adhesive tape coincide during lamination, meaning a tension-free application of the adhesive tape 16 takes place on the prescribed contact surface of the object 12, unless a controlled compression or stretching of the adhesive tape 16 is desired.

Using the teaching according to the invention the adhesive tape 16 is transferred tension-neutral to the object 12, meaning the longitudinal edge 14 or 15. This is possible because the conveyor belt 58 is moved completely synchronously with the adhesive tape 16 during the lamination of the object 12. Because the transport station 22 can be pivoted, the required pressurization of the adhesive tape 16 in the direction of the longitudinal edge 14 or 15 to be laminated can be adjusted. In the context it is not stringently necessary that the pivoting axis of the transport station 22 coincides with the drive axis 56, as this has been explained in the context of FIG. 1.

The adhesive tape 16 is cut through by means of the cutting installation 20 at the point that coincides with the end of the coating on the product 12, so that the longitudinal edge is provided with the adhesive tape 16 exactly aligned from beginning to end.

Once the edge is laminated the transport station 22 is pivoted back, as it is clarified purely in principle by FIG. 2. By these means a separation of the adhesive tape section that adheres to the conveyor belt 18 from the one that has been laminated onto the longitudinal edge 14 or 15 also takes place.

For completeness it should be noted that, when a new spool 18 is used, the liner 26, meaning its starting section, is initially connected with shaft 24, meaning fixed to it, so that the reeling-up can take place.

Feeding the tape 28 takes place via the conveyor belt 58 during the laminating of the object 12. The transport force is transferred via the liner 26 from the spool 18 all the way to the conveyor belt 58. Then the transfer to the conveyor belt 58 takes place. After the liner has been peeled-off, the conveyor belt 58 takes on the longitudinal forces of the transport completely. In the process the adhesive tape 16 is laid out on the conveyor belt 58 and it is not stretched.

The drive axis for the conveyor belt 58 can be controlled via the controller 70 of the handling device 72 in such a manner that a compressed or a stretched application of the adhesive tape 16 is performed. Irrespective of that the teaching according to the invention is realized in that the velocity and acceleration progression of the object 12 is mapped onto the drive axis of the transport installation in real time, wherein the velocity or acceleration of the surface velocity of the object 12 deviates from the feed velocity of the adhesive tape by a prescribed factor in order to assure in a controlled manner the desired compressed or stretched application.

The adhesive tape 16 protrudes slightly laterally beyond the longitudinal edge 14 or 15. In an attendant processing station the laterally protruding edges are crimped in order to be pressed against the longitudinal side edges of the object 12.

If the teaching according to the invention is described based on a double adhesive tape with a liner, the teaching according to the invention is not limited thereby. The possibility also exists to use a double adhesive tape with two liners, wherein one of the liners is peeled off prior to the cutting installation. If applicable, an adhesive tape could also be used that does not stringently feature an adhesive layer on both sides. It has to be however assured that the adhesive tape is grasped by the conveyor belt in such a manner that a relative movement between them cannot take place after the laying out of the adhesive tape on the conveyor belt.

Furthermore the method according to the invention is preferably utilized for the covering of the circumferential edges of a solar cell module. This also however does not represent a limitation of the teaching according to the invention.

The invention claimed is:

1. A method for laminating an object, or the edge of the object, with an adhesive tape, the method comprising the steps of:

providing an object to be laminated;

providing an adhesive tape;

providing a handling device, said handling device having an axle;

transporting the object using the handling device, transporting the adhesive tape, contacting the object with the adhesive tape, and laminating the object with the adhesive tape; and synchronously transmitting the velocity and acceleration progression of the object to the transporting of the adhesive tape via the axle of the handling device, so that the velocity and acceleration of the object and the velocity and acceleration of the adhesive tape are actively synchronized in real time, and are equal, during the laminating step;

wherein the adhesive tape is applied to the object via a conveyor belt;

wherein the conveyor belt is guided across a plurality of rollers;

wherein one roller of the plurality of rollers is a drive roller having a drive axis; and wherein the conveyor belt and the plurality of rollers are pivotable as a unit about the drive axis.

2. The method according to claim 1, wherein the length of the contact area for the adhesive tape on the conveyor belt is independent of the length of the adhesive tape section that is to be applied to the object.

3. The method according to claim 2, wherein the adhesive tape further comprises a liner, and wherein the adhesive tape is transferred to the conveyor belt in a tension-free manner by means of the liner.

4. The method according to claim 3, wherein the required transport force for transporting the adhesive tape until the deposition onto the conveyor belt is transferred via the liner.

5. The method according to claim 3, wherein the liner is pulled off the adhesive tape after the adhesive tape has been received by the conveyor belt, wherein, after the peeling-off of the liner, the transport force for the transport of the adhesive tape is assumed by the conveyor belt.

6. The method according to claim 3, wherein a roller reels up the liner, and wherein the roller is actuated via a motor with an adjustable torque.

7. The method according to claim 3, wherein a tape comprising the adhesive tape and the liner is pulled off a spool and is redirected via a tensioning pulley that abuts against the spool, wherein the tensioning pulley is actuated in the direction opposite to the peel-off direction of the tape.

8. The method according to claim 3, wherein the adhesive tape is cut or perforated by means of a cutting device, without the liner being cut through or perforated, depending on the length thereof that is to be laminated onto the object.

9. The method according to claim 8, wherein, during the cutting through or perforating of the adhesive tape, the conveyor belt is halted.

10. The method according to claim 8, wherein the cutting device comprises a heated and/or a coated separating element.

11. The method according to claim 3, wherein the tape that comprises the adhesive tape and the liner is transported over the entire transport path thereof without stretching.

12. The method according to claim 1, wherein the drive axis is controlled and adjustable via the controller of the handling device.

13. The method according to claim 1, wherein the conveyor belt is guided across two rollers that are pivotable as a unit.

14. The method according to claim 13, wherein the liner is collected upon a roller after the adhesive tape is laminated; and wherein said roller is actuated via a roller with adjustable torque.

15. The method according to claim 13, wherein the press-on force of the adhesive tape onto the object is adjusted by means of the pivoting of the unit.

16. The method according to claim 13, wherein the two rollers are arranged essentially vertically, one above the other, and wherein a pressing roller for the adhering of the adhesive tape to the conveyor belt is associated with a lower one of the two rollers.

17. The method according to claim 16, wherein a liner deflection roller is associated with an upper roller of the two rollers, via which the liner is separated from the adhesive tape and guided to an actuated roller that reels the liner up.

18. The method according to claim 17, wherein the upper roller is used as the roller with the drive axis.

19. The method according to claim 1, wherein the conveyor belt is guided across three rollers that are pivotable as a unit.

20. The method according to claim 1, wherein the tension of the tape is adjusted via the torque of the drive of the tensioning pulley.

21. The method according to claim 1, wherein the tape that is peeled-off from the spool is redirected vertically via a guiding roller.

22. The method according to claim 1, wherein the tape is aligned laterally via guiding elements.

23. The method according to claim 1, wherein the adhesive tape is cut through or perforated by means of a cutting device that moves along with the adhesive tape.

24. The method according to claim 1, wherein the adhesive tape is applied to the object without tension.

25. The method according to claim 1, wherein the velocity and acceleration progression of the object is transmitted to the transport of the adhesive tape in such a manner that the adhesive tape is applied to the object with the desired tension.

26. The method according to claim 1, comprising moving the axle of the handling device synchronously with the transporting of the object.

27. The method according to claim 1, comprising transporting the object and the adhesive tape using a common electronic shaft.

28. The method according to claim 1, wherein the conveyor belt is guided across four rollers that are pivotable as a unit.

* * * * *